United States Patent [19]

Meckl et al.

[11] 4,038,079

[45] July 26, 1977

[54] PROCESS FOR THE REGENERATION OF PHOTOGRAPHIC BLEACH-FIX BATHS

[75] Inventors: Heinz Meckl, Schildgen; Helmut Häseler, Leverkusen; Adolf Seiler, Hitdorf, all of Germany

[73] Assignee: AGFA-Gevaert Aktiengesellschaft, Leverkusen, Germany

[21] Appl. No.: 606,722

[22] Filed: Aug. 21, 1975

Related U.S. Application Data

[63] Continuation of Ser. No. 244,949, April 17, 1972, abandoned.

[30] Foreign Application Priority Data

July 27, 1971 Germany ..... 2137549

[51] Int. Cl.[2] ..... G03C 5/26; G03C 5/32

[52] U.S. Cl. ..... 96/60 BF; 96/50 A

[58] Field of Search ..... 96/60 BF, 50 A; 75/118 P

[56] References Cited

U.S. PATENT DOCUMENTS

| | | | |
|---|---|---|---|
| 1,448,475 | 3/1923 | Weisberg | 75/118 P |
| 1,624,172 | 4/1927 | Levy | 75/109 |
| 2,503,104 | 4/1950 | Farber | 75/118 P |
| 3,082,079 | 3/1963 | Bulloch et al. | 75/118 P |
| 3,700,450 | 10/1972 | Cooley | 96/60 BF |
| 3,767,401 | 10/1973 | Newman et al. | 96/60 BF |
| 3,832,453 | 8/1974 | Slovonsky et al. | 96/60 BF |

FOREIGN PATENT DOCUMENTS

| | | | |
|---|---|---|---|
| 777,635 | 6/1957 | United Kingdom | 96/60 BF |
| 1,131,096 | 10/1968 | United Kingdom | 96/60 BF |

*Primary Examiner*—Mary F. Kelley
*Attorney, Agent, or Firm*—Connolly and Hutz

[57] ABSTRACT

Photographic bleach-fix baths containing iron-III-complexes of aminopolyacetic acids as oxidizing agents are rejuvenated by reducing the iron-III-complexes with a reducing agent other the iron and thereafter are desilvered by treatment with iron.

2 Claims, No Drawings

PROCESS FOR THE REGENERATION OF PHOTOGRAPHIC BLEACH-FIX BATHS

CROSS-REFERENCE TO RELATED APPLICATION

This application is a continuation of Ser. No. 244,949 filed Apr. 17, 1972, now abandoned.

The invention relates to a process for desilvering photographic bleach-fix baths which contain complex salts of trivalent iron and aminopolycarboxylic acids as oxidizing agents.

It is known to use so-called bleach-fix baths in the processing of color photographic silver halide recording materials and thus to simplify processing by combining bleaching and fixing in a single process. These bleach-fix baths are being used to an increasing extent in color photographic processes instead of bleaching baths which contain potassium ferricyanide. This is mainly because of the regulations for preventing pollution in waste waters.

When producing photographic reflection copies and films by chromogenic development or silver dye bleaching process, it is necessary to remove the silver image which is formed in addition to the dye image. This must be done by oxidizing the silver of the silver image and removing it with a silver halide solvent. A bleach-fix bath contains an oxidizing agent, e.g. the trivalent iron complex of ethylene diaminotetracetic acid, and thiosulfate as silver halide solvent. Silver thiosulfate accumulates in the bath during the process.

For economical reasons and on account of the water pollution regulations it is necessary to recover the silver and re-use the bath as far as possible.

The main methods which have become established for the regeneration of used conventional fixing baths are the electrolytic reduction and the chemical reduction of silver ions to elementary silver.

One of the commonest methods of chemical reduction of silver ions is the reaction with less noble metals such as zinc dust or iron wherein the silver is precipitated. This reaction is also called cementation.

These known methods, however, cannot be applied directly to bleach-fix baths. The process of desilvering a used bleach-fix bath with iron, e.g. in the form of steel wool, takes place in two stages. A proportion of the steel wool, corresponding to the quantity of iron (III) complex, is first oxidized in the absence of air to reduce the complex to the divalent complex. Only in the second stage, the very cementation, the iron is dissolved to effect deposition of the equivalent quantity of silver. If the bath does not contain any excess of substances which will form complexes with iron, the precipitated iron salts interfere with the flow of the bath through the steel wool and thus prevent optimum utilisation of the steel wool.

Although the precipitation of the iron salts can be prevented by ensuring that sufficient complex forming substance is present during the desilvering process, this method has the disadvantage that each time the bleach-fix bath is re-used after a desilvering process, the concentration of iron complex is increased. Increasing quantities of steel wool are therefore required for each desilvering process to reduce the increasing quantities of iron complex. The only method then left available is to dilute the desilvered bath to the nominal value of the iron complex and to discard the excess. It is an object of this invention to find a process for the desilvering of used bleach-fix baths containing complex iron compounds so that the increase in concentration of the iron complex can be substantially diminished and the deposition of sludge prevented.

It has now been found that this problem can be solved if the iron complex of the bleach-fix bath is reduced in a certain manner before the desilvering process so that in the subsequent desilvering by iron no iron is needed to reduce trivalent iron complex.

This invention therefore relates to a process for the desilvering of photographic bleach-fix baths which contain iron III complexes of aminopolyacetic acids as oxidizing agents by precipitation with iron, which process is characterized in that the oxidizing agent iron III complexes of aminopolyacetic acids are reduced with a reducing agent other than iron before the desilvering with iron is carried out.

The main advantages achieved with the invention is that no iron is dissolved over and above the quantity used for deposition of silver and that the prevention of the formation of sludge in the process of desilvering carried out after reduction of the iron complex can be achieved with substantially smaller quantities of complex forming agent than are required for reduction of the complex with steel wool. The bath wastage and hence loss of chemicals and the pollution of the effluent are kept low.

Reducing agents suitable for the preliminary reduction according to the invention are those which reduce the trivalent iron complex e.g. dithionites, phosphites, hypophosphites, boranates, water-soluble hydrazine derivatives, hydroxylamines, ascorbic acid, semicarbazide, carbohydrazide, formamidine sulfinic acids. Sodium dithionite, which is oxidized to sodium sulfite, a necessary constituent of bleach-fix baths, is particularly suitable.

The process according to the invention may suitably be carried out on any of the usual spent bleach-fix baths, in other words bleach-fix baths which contain reduced bleaching or oxidizing agents and silver thiosulfate complex ions.

The quantity of reducing agent required for the process of the invention depends on the quantity of iron complex present in the bleach-fix bath but is otherwise not very critcal for effective operation of the process of the invention. The action of the reducing agent can easily be followed by observing the color change of the bath from deep red to pale yellow. The required quantity of reducing agent may also be controlled by means of the redox potential measured with a platinum-silver chloride electrode system. Generally, the bleach bath after reduction has a pH-value between 4 and 9 and can be used for the subsequent desilvering without any further treatment or change in pH-value.

The process of the invention has practically no influence on the time required for regenerating the bleach-fix baths. Otherwise stated, by the additional preliminary reduction the time necessary for the complete regeneration is extended only little. The temperatures of the baths which are to be regenerated may also vary widely, the upper temperature limit being mainly determined by the stability of the given bleach-fix baths.

Bleach-fix baths regenerated by the process of the invention may contain the usual silver bleaching agents used in such baths, namely compounds which oxidize silver to silver ions.

The oxidizing agents used in the bleach-fix baths may, for example, be salts of metals which occur in several stages of oxidation, for example copper (II) salts such as copper (II) chloride, nitrate or sulfate. Other suitable oxidizing agents are the water soluble salts of trivalent cobalt such as the chloride, and the nitrate complexes and in particular water-soluble iron (III) salts, for example iron (III) chloride, nitrate, thiocyanate or oxalate, or also complex iron (III) compounds, e.g. ferricyanides such as sodium ferricyanide, potassium ferricyanide and ammonium ferricyanide. Other examples are the complex salts of an alkali metal and a polyvalent cation consisting of an iron (III), cobalt (III) or copper (II) ion with organic acids such as ethylene diaminotetracetic acid, nitrilotriacetic acid, malonic acid, ethylmalonic acid, tartaric acid, maleic acid, fumaric acid, diglycollic acid, ethyliminodiporpionic acid, ethylenedithioglycollic acid and dithioglycollic acid. The preferred oxidizing agents used are iron (III) complexes of aminopolyacetic acids and especially of ethylene diaminotetracetic acid.

The bleach-fix baths which may be regenerated according to the invention may contain the usual fixing agents or silver halide solvents used for such baths, i.e. combinations of a fixing agent with a bleaching agent. Suitable fixing agents, apart from the thiosulfates already mentioned above, include other silver salt solvents, for example certain aliphatic dihydroxy compounds which may contain sulfur atoms in the carbon chain, e.g. 3-thiapentane-1,5-diol or 3,6-dithiaoctane-1,8-diol or aliphatic dicarboxylic acids which contain sulfur, e.g. 2,5-dithiahexane-1,6-dicarboxylic acid or high concentrations of thiocyanate ions or halogen ions such as bromide or iodide.

Lastly, the bleach-fix baths regenerated in accordance with the invention may also contain the usual known additives, for example pH buffers such as phosphates, borates, ethlenediaminetetracetates and sulfites, mercapto derivatives and 5-membered heterocyclic rings, e.g. mercaptotriazole as well as all kinds of known white couplers, compounds of the latter-mentioned type are capable of reacting with oxidation products of color developers to form colorless products. Reference is made for example to the publication of W. Puschel in "Mitteilungen aus den Forschungslaboratorien der Agfa-Gevaert", volume IV, page 352. The pH of the bleach-fix bath is generally between 6,0 and 8,5 e.g. about 7.7.

The process according to the invention is particularly suitable inter alia for regenerating bleach-fix baths used for the development of photographic multilayered recording materials in which the layers contain color couplers. These include the so-called negative-positive recording materials and the known reversal materials in which color development is preceded by a black-white development of the photographic reversal material in a conventional black and white developer, e.g. of the hydroquinone type.

The reducing agent may be added either to the collected bleach-fix overflow or directly to the effluent bleach-fix proportional to the rate of overflow. After the reduction, the desilvering of spent bleach-fix baths with steel wool may be carried out continuously, in which case the bleach-fix bath which is to be desilvered is passed through a commercially available cartridge filled with steel wool. It may also be carried out batchwise, the spent bleach-fix bath being reacted with the steel wool with exclusion of air. This exclusion of air can be achieved in known manner by means of a floating cover. This cover floats on the surface of the bleach-fix bath which is kept in a container wherein the desilvering is carried out. The cover's shape is such that it covers the free surface of the liquid and protects it against contact the air. When desilvering has been carried out, the iron complex is reoxidized by introducing air, and the bleach-fix bath is then made ready for re-use by the addition of regenerator substances.

Used bleach-fix baths can easily be desilvered practically completely by the process of the invention. As a result of the preliminary reduction, the formation of sludge which interferes with the desilvering with iron wool can be prevented with smaller quantities of iron complex forming substance than is possible when reduction is carried out with iron alone. Moreover, the quantity of iron required for desilvering is reduced by the amount which is otherwise necessary for reducing the iron (III) complex. Lastly, the preliminary reduction according to the invention substantially diminishes the increase in concentration of the iron complex of aminopolyacetic acid, and the quantity of water required for adjusting the bath to its initial concentration is therefore correspondingly reduced. The losses in excess bleach-fix baths are kept lower than in desilvering carried out without preliminary reduction. The invention therefore enables the losses in bath liquid and hence in chemicals to be kept low, which is to the economic advantage of the photographic process, and owing to the reduced loss of bath the contamination of effluent is correspondingly reduced.

EXAMPLE 1

Desilvering of a bleach-fix bath without preliminary reduction. The bath contains a small excess of complex forming substance and has the following composition per liter:

| | |
|---|---|
| Silver in the form of AgCl | 3.3 g |
| Tetrasodium salt of ethylenediaminotetracetiy acid as complex forming substance | 5.0 g |
| Sodium salt of iron (III) complex of ethylene diaminotetracetic acid | 30. g |
| Anhydrous disodium hydrogen phosphate | 15. g |
| Anhydrous sodium sulfite | 5 g |
| Ammonium thiosulfate | 100 g |

The pH of the bath is adjusted to 5.5 with acetic acid. The bath is then treated with 7 g of steel wool number 0 (marketed by Weber & Wittel, Reutlingen/Betzingen). per liter with exclusion of air. The pH then drops to 5.3.

Desilvering is accompanied by heavy sludge formation. The concentration of the iron complex increases. After a treatment time of 45 minutes the bath still contains 0.14 g of silver.

EXAMPLE 2

Desilvering of a bleach-fix bath without preliminary reduction. The bath contains a larger excess of complex forming substance, namely 25 g of ethylene diaminotetracetic acid per liter, but has otherwise the same composition as in Example 1. The pH is adjusted to 5.8 with potassium carbonate. The treatment is otherwise the same as in Example 1. Desilvering proceeds without sludge formation. The concentration of iron complex greatly increases. After 45 minutes treatment, the bath contains a residual quantitiy of 0.013 g of silver per liter.

EXAMPLE 3

Desilvering of a bleach-fix bath with preliminary reduction using sodium dithionite. The composition of the bath is the same as in Example 1 but before the treatment with steel wool, sodium dithionite is added up to a redox potential of −200 mV measured with a platinum-silver chloride electrode system. A color change from deep red to pale yellow takes place corresponding to the reduction of the trivalent iron complex to the divalent iron complex.

The pH is adjusted to 5.3 with acetic acid because no drop in pH occurs as in Examples 1 and 2.

Desilvering proceeds without sludge formation. The concentration of iron complex increases much less that in Examples 1 and 2. The bath contains a residue of 0.006 g of silver per liter after 45 minutes treatment.

The results of Example 1 to 3 are summarized in the following table.

| Example | Complex forming ethylenediamino-tetracetic acid per liter | sludge formation | Silver content per liter after 45 minutes desilvering | Increase in concentration of the iron complex after desilvering |
|---|---|---|---|---|
| 1 without prelim-inary reduction | 5 g | heavy | 0.14 g | 20 % |
| 2 without prelim-inary reduction | 25 g | none | 0.013 g | 90 % |
| 3 prelimin-ary reduc-tion with sodium dithionite | 5 g | none | 0.006 g | 16 % |

EXAMPLE 4

Desilvering of a bleach-fix overflow with reduction using sodium dithionite before the solution enters the recovery cartridge filled with steel wool.

| Ingredients of bleachfix overflow per liter: | |
|---|---|
| Tetra-sodium salt of ethylenediaminetetraacetic acid | 35 g |
| Na Fe(III) salt of ethylenediaminetetraacetic acid | 45 g |
| Sodium carbonate anhydrous | 11 g |
| Sodium sulfite anhydrous | 8 g |
| Ammoniumthiosulfate | 100 g |
| Silver | 3.5 g |
| pH 7.7 to 8.0 | |

The bleach-fix overflow is collected in a holding tank and the iron-III-complex is reduced by adding sodium dithionite until the redox potential of − 250 m V is reached. About 10 g of sodium dithionite per liter are necessary for this purpose. Thus, also the pH of the solution changes to 6.4 – 6.7.

This non-oxidizing solution circulates through the recovery cartridge and is then free of silver and contamination by iron hydroxide.

During desilvering iron goes into solution and by reaction with free complex-former increases the amount of iron-III-complex in the solution by about 15%.

Under the same conditions but without reduction before desilvering, the iron complex is increased by about 40%. This needs more dilution and therefore more waste of chemicals.

Furthermore the desilvering of bleach-fix in accordance with the invention allows doubling the capacity of the recovery cartridge and to increase the throughput rate threetimes.

The desilvered solution is aerated and regenerator chemicals are added to complete the replenisher for reuse.

We claim:

1. The method of desilvering a photographic bleach-fix bath, containing accumulated dissolved silver and also containing an iron (III) complex of aminopolyacetic acid, by contacting the bath with metallic iron, the improvement which comprises treating the bath containing the iron (III) complex of aminopolyacetic acids in a preliminary reduction step with a reducing agent, selected from the group consisting of dithionites, phosphites, hypophosphites, boronates, water-soluble hydrazine derivatives, hydroxylamines, ascorbic acid, semicarbazide, carbohydrazide, formamidine sulvinic acid and sulfinic acid before the bath is contacted with the metallic iron, said preliminary reduction step being carried out by adding the said reducing agent to the bath in order to reduce the iron (III) complex until the iron (III) complex is essentially reduced to the iron (II) complex and before a reduction of the dissolved silver, and after this preliminary reduction step then desilvering the bath by metallic replacement.

2. The method of claim 1 wherein the reducing agent is dithionite.

* * * * *